US005323134A

United States Patent [19]

Patterson et al.

[11] Patent Number: 5,323,134

[45] Date of Patent: Jun. 21, 1994

[54] SOLENOID DEVICE

[76] Inventors: David Patterson, R.R. #6, Smith Falls, Ontario, K7A 4S7; Albert Patterson, R.R. #4, West Lorne, Ontario, N0L 2P0, both of Canada

[21] Appl. No.: 33,803

[22] Filed: Mar. 18, 1993

[51] Int. Cl.[5] ..... H01F 7/08

[52] U.S. Cl. ..... 335/223; 335/236; 335/246; 335/253

[58] Field of Search ..... 335/21, 22, 149, 167, 335/168, 169, 222, 223-227, 236, 237, 246, 253

*Primary Examiner*—Leo P. Picard
*Assistant Examiner*—Raymond Barrera
*Attorney, Agent, or Firm*—Burke-Robertson

[57] ABSTRACT

A solenoid comprising a first coil positioned within a frame from which a magnetizable armature, having a coil end and a free end, extends, the coil end of the armature having a section of non-magnetizable material secured to it, and a second coil, which coil is energizable in a manner independent from that of the first coil, the second coil being secured to the other end of the non-magnetizable material so as to move with the armature from a position adjacent the first coil when the armature is in extended position to a position spaced therefrom when the armature is in retracted position, whereby when the first coil is energized to move the armature along its throw into retracted position, the second coil is simultaneously energized so as produce a repulsive magnetic force with respect to that of the first coil. Magnetizable bridge devices are secured to the frame and automatically movable, upon energization of the coil and movement of the armature along its throw to retracted position, to become seatably positioned within the space between the coils over an end of the first coil in contact with the armature to provide across the coil end of the armature a magnetically conductive path for the magnetic field which will hold the armature firmly in retracted position, and, upon de-energization of the coils and return of the armature to its extended position, to become automatically moved from its seated position to a position and become clear of the space between the first and second coils.

12 Claims, 3 Drawing Sheets

SOLENOID DEVICE

BACKGROUND OF THE INVENTION

The present invention relates to an improved solenoid. Conventional solenoids have an electrically energizable coil consisting of one or more layers of windings about a non-magnetic form producing an electromagnet when the coil is energized. A magnetic armature extends from this form and moves within it. In one construction of solenoid this armature moves to a retracted position when the coil is energized and to an extended position under urging from a biasing means when the coil is de-energized. The distance between these positions is known as the "throw" of the solenoid.

Such solenoid device is widely used for operating circuit breakers, track switches, valves and many other electro-mechanical devices. They may be used to operate door locks on cars, in automatic nailer and stapler machines, as electrical motor starters, as contactors on starting equipment, and on fuel racks for diesel engines and the like.

Problems with such conventional solenoids however have limited their applications and usage. For example, with the armature in extended position, because the inner end of the armature is at its position most remote from the corresponding magnetic pole, there is relatively little starting power available to attract the armature into the coil when the coil is energized. As well, the throw is limited by the amount of magnetic strength available when the coil is energized. In practical terms the throw may for instance only be about an inch. In order to overcome these limitations, the current to windings may be increased. Increased current however results in increased heat being generated when the coil is energized, which heat reduces the ability of the coil to function as an electromagnet and reduces the life of the device and components which may surround it.

In our invention as described in our co-pending U.S. patent application Ser. No. 07/890,820 filed Jun. 1, 1992, an improved solenoid construction was described and illustrated which overcame these problems. In particular, the coil end of the armature has secured to it a pre-determined length of rigid non-magnetizable material. A second, electrically energizable coil is energizable in a manner opposite to that of the first coil, and is secured to the other end of the length of non-magnetizable material so as to move with the armature. When this second coil is energized, it moves from a position adjacent the first coil (with the armature in extended position), to one spaced therefrom with the armature in retracted position. The energization of the two coils provides magnetic repulsion between adjacent, like magnetic poles of the two coils to produce excellent starting power for the armature. This improved solenoid construction also permits an increased throw compared to conventional solenoids.

One problem with such a construction of solenoid, for particular applications which require a solenoid in which the armature is very strongly held in retracted (coil-activated) position is that the armature is not locked in this position as strongly as would be the case with a conventional solenoid. This is because, when the armature is in this retracted position with the coils energized, the locking of the (heavier) armature in this retracted position is still achieved mainly through the effects on the inner end of the armature by the magnetic field created by the first coil.

It is an object of the present invention to provide an improved construction of such a solenoid which will have significantly increased power in holding the armature firmly in retracted, locked position.

SUMMARY OF THE INVENTION

In accordance with the invention there is provided a solenoid of the type comprising an electrically energizable first coil positioned within a frame and consisting of one or more layers of windings about a non-magnetic form. A magnetizable armature, having a coil end and a free end, extends from the coil. The coil end of the armature moves within the coil between retracted position when the first coil is energized and extended position when the first coil is de-energized, the distance between those positions being the distance of throw of the solenoid armature. The coil end of the armature has a section of rigid non-magnetizable material of predetermined length secured to it so as to move with the armature. A second, electrically energizable coil, consisting of one or more layers of windings about a non-magnetic form, which windings and form circumscribe a magnetizable core and are energizable in a manner independent from that of the first coil, has its core secured to the other end of the length of non-magnetizable material so as to move the second coil with the armature from a position adjacent the first coil when the armature is in extended position to a position spaced therefrom when the armature is in retracted position. When the first coil is energized to move the armature along its throw into retracted position, the second coil is simultaneously energized so as produce a repulsive magnetic force with respect to that of the first coil. The improvement presented by this invention is characterized by magnetizable bridge means being secured to the frame and automatically movable, upon energization of the coils and movement of the armature along its throw to retracted position, to become seatably positioned within the space between the coils in contact with the armature to provide across the coil end of the armature a magnetically conductive path for the magnetic field. Upon de-energization of the coils, and return of the armature to its extended position, the bridge means becomes automatically moved from its seated position, to a position clear of the space between the first and second coils.

In a preferred embodiment of the present invention the first coil is circumscribed by a magnetizable cage means wherein, when the magnetizable bridge means is moved into seated position, the bridge means simultaneously contacts the armature and the cage means, the cage and bridge means thereby providing a magnetically conductive path about the first coil for the magnetic field.

It is also preferred that the magnetizable bridge means comprises a plurality of strips of magnetically conductive material arranged to move clear of the space between the coils when the first coil is de-energized and the armature moves from retracted position to extended position with the coils adjacent each other, and into seated position when that coil is energized and the armature moves to retracted position.

In a further, preferred embodiment of the present invention, similar bridge means and magnetizable cage means are provided for the second coil.

The solenoid constructions of the present invention permit the magnetic field from the first coil or from both coils to flow directly through the bridge means and, where a cage means is provided, through the cage means as well, to facilitate firmly holding the armature in retracted position without consuming excess electrical energy. As well, the physical attraction of the bridge means to the armature and coil, as well as to the cage further ensures enhanced locking strength over the prior art solenoid construction described and illustrated in our co-pending U.S. application Ser. No. 07/890,820.

BRIEF DESCRIPTION OF THE DRAWINGS

These and other objects and advantages of the invention will become apparent upon reading the following detailed description and upon referring to the drawings in which.

Figure 1:
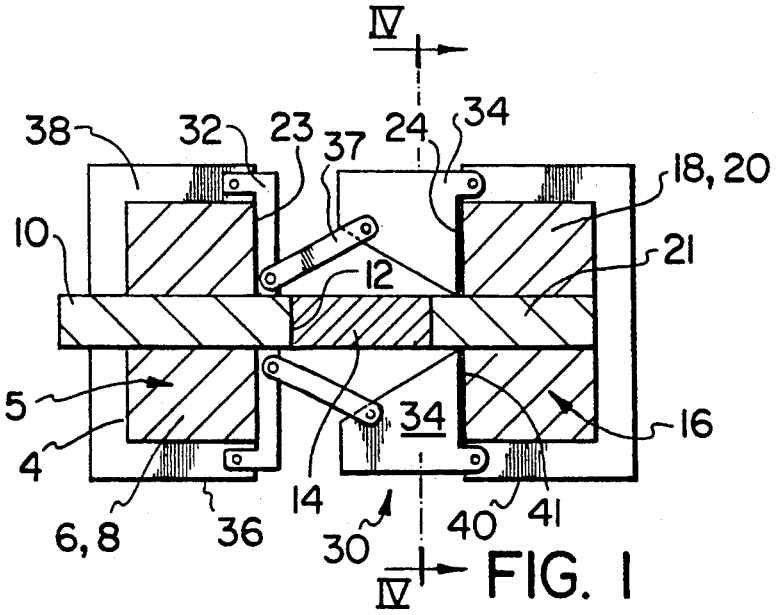
FIG. 1 is a schematic section view of a preferred embodiment of solenoid in accordance with the present invention, adapted for A.C. or D.C. applications, with the armature in retracted position, and first and second coils activated.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Figure 2:
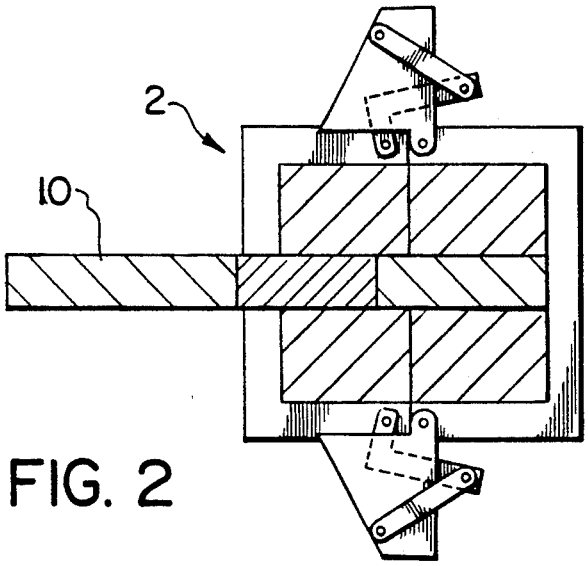
FIG. 2 is a schematic section view of the solenoid of FIG. 1 with the armature in extended position, the coils being de-activated.

Turning to the drawings and in particular FIGS. 1 to 4, there is shown a preferred embodiment of solenoid 2 in accordance with the present invention. In the schematic section view of FIG. 1, the solenoid is shown in retracted position. In FIG. 2 it is shown in extended position.

Solenoid 2 comprises, within a cage 4, a coil 5 formed of one or more layers of windings 6 about a non-magnetic form 8, from which armature 10 extends and within which armature 10 moves between a starting, extended position (FIG. 2) when first coil 5 is not energized, and a retracted position (FIG. 1) when coil 2 is energized. Armature 10 may be made for example of steel.

In accordance with our invention as described and illustrated in our corresponding U.S. application Ser. No. 07/890,820, secured to the coil end 12 of armature 10 a non-magnetizable section 14 which section is of predetermined length, and may for example be of brass or appropriate non-magnetizable other metal or ceramic, nylon etc. To the other end of section 14 is secured an electrically energizable second coil 16, which coil again consists of one or more layers of windings 18 about a non-magnetic form 20. Form 20 is wrapped about and secured to a steel core 21. As coil 16 must move in conjunction with the movement of armature 10, there must be sufficient space within 4 to permit that movement.

With this type of solenoid 2, the windings 18 of coil 16 are energizable in a manner opposite to that of first coil 5, i.e. when the two coils are energized, confronting faces 23 and 24 are of similar magnetic polarity so that there will be strong repulsion between these confronting faces. It will be understood that this repulsive force will be at its strongest when coils 5 and 16 are first energized, in the position illustrated in FIG. 2, thereby providing significant initial power to commence the retraction of armature 10. As the distance between confronting faces 23 and 24 increases, after simultaneous energization of coils 5 and 16, coil end 12 of armature 10 approaches the inner end of coil 5. As it does so, the attractive forces on that end created by coil 5 increase. Thus, as previously disclosed in our aforementioned U.S. patent application, as the repulsive forces between the two coils diminish, the attractive forces of coil 5 on the inner end 12 of armature 10 increase, ensuring that strong initial, as well as strong terminal forces draw armature 10 into retracted position (FIG. 1).

The forces maintaining armature 10 in this retracted position arise mainly from the magnetic forces exerted by coil 5 on coil end 12 of armature 10. To enhance the securing of armature 10 in this retracted position, in accordance with the present invention a plurality of magnetic bridge means 30 are provided. In the embodiment of FIGS. 1 to 5, these bridge means comprise a plurality of hinged dogs 32 and 34 which are pivotally hinged to case 4. Dogs 32 and 34 are, in the illustrated embodiment, made of an appropriate material such as steel which will act as a conductor of magnetic fields. They are joined, as illustrated by an appropriate pivoting link 3 made of non-magnetizable material such as brass.

The construction and operation of dogs 32 and 34 can be readily understood from FIGS. 1 and 2. When armature 10 is in retracted position with coils 5 and 16 energized (FIG. 1), dog 32 is pivoted into position over the inner end 23 of coil 5, contacting armature 10 at or near its inner end 12. This provides a conductor for the magnetic field generated by coil 5. A plurality of ribs 38 of steel or other such magnetizable material is provided about coil 5, as illustrated, with the dog 32 being also in contact with a corresponding rib 38, when armature 10 is in this retracted position with coil 5 energized. In this manner, a magnetically conductive shell is provided about coil 5, thereby enhancing the effects of that magnetic field while at the same time providing a mechanical block on armature 10, to provide greater locking forces on armature 10 in this retracted position.

In a similar manner, dog 34 is positioned across the inner end 24 of coil 16 when armature 10 is in this retracted position. A plurality of steel ribs 40 similarly circumscribe coil 16 as illustrated. Dog 34, when in position as illustrated in FIG. 1, is in contact with magnetizable core 21 providing a convenient path for flow of magnetic field through dog 34 and ribs 40 when coil 16 is energized in this position. Again the effects of the magnetic field generated by coil 16 is enhanced by dog 34 by ribs 40 and dogs 34 thus positioned, enhancing both the magnetic and mechanical locking effect on armature 10 in this retracted position.

When it is desired to de-activate coils 5 and 16 to permit armature 10 to be drawn out to its extended position (FIG. 2), link 37 is pivotally attached to dogs 32 and 34 as illustrated, and those dogs are pivotally attached to case 4 in a manner such that the force exerted by coil 16 on inner edge 41 of dog 34 will cause dog 34 to swing upwardly clear of the space between coil 16 and 5, simultaneously drawing link 37, and dog 32 simultaneously clear of that space, and freeing coil 16 to move into position adjacent coil 5, when armature 10 is in its extended position. Dogs 32 and 34 and link 37 are constructed and hinged so that this action of clearing them from the space between coils 5 and 16, when the coils are de-energized, or conversely drawing them into that space, into seated position as illustrated in FIG. 1, occurs automatically.

Figure 3:
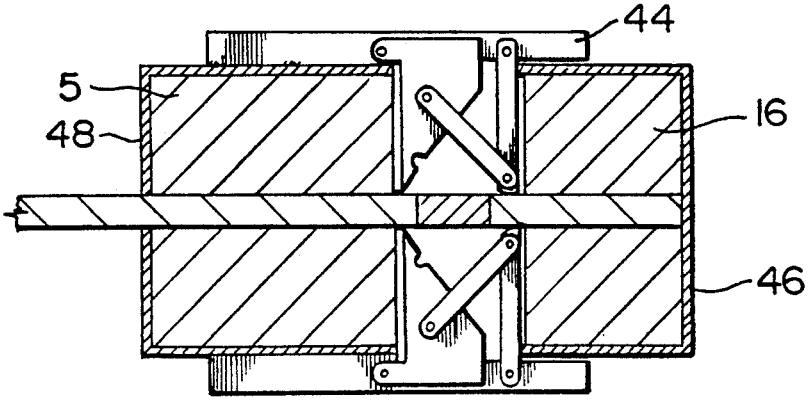
FIG. 3 is a schematic section view of an embodiment of solenoid according to FIGS. 1 and 2, adapted strictly for D.C. use.
Figure 4:
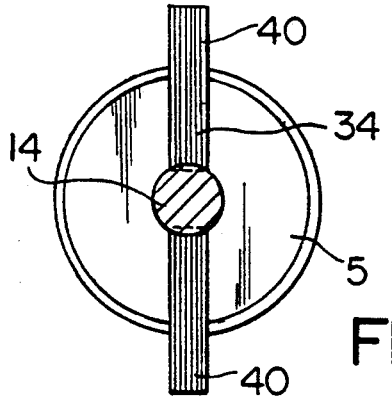
FIG. 4 is a section view of the solenoid of FIG. 1 along line IV—IV.

While the magnetic bridge means 30, in the embodiments of FIG. 2, on the one hand, and FIG. 3, on the other, are of a similar nature, the solenoid of FIGS. 1 and 2 is intended for A.C. or D.C. applications. Thus, armature 10 and steel core 21, as well as hinged dogs 34 are made of laminated steel. These components of the embodiment illustrated in FIG. 3 need not be laminated. As well, in the embodiment of FIG. 3, the solenoid itself is preferably retained within a non-magnetizable casing 44, for example, of brass, with coil 16 sitting within a steel casing 46, and coil 5 seated within a steel casing 48. These steel casings enhance the flow of magnetic current about their respective coils, when those coils are activated.

Figure 5:
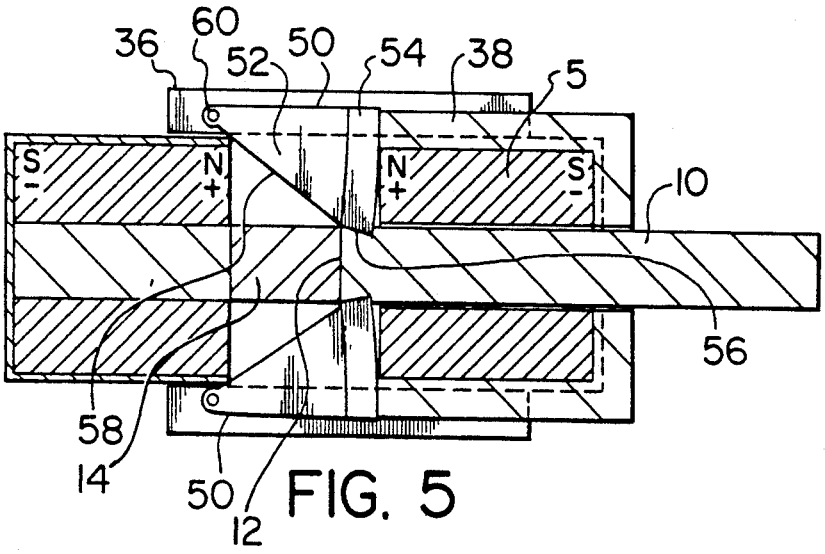
FIGS. 5 and 6 are schematic section views of an alternative embodiment of solenoid in accordance with the present invention with the armature respectively being shown in retracted (activated) position and extended (de-activated) position.

In the alternative embodiment illustrated in FIG. 5, a plurality of dogs 50 pivotally hinged to support 36, is provided to swing into seated engagement with respect to only coil 5, contacting armature 10 and ribs 38 as illustrated, when coil 5 is in energized position. Dogs 50 are preferably constructed of an upper portion 52 of brass or other material which will not interfere with magnetic fields, and a lower strip 54 of steel or other magnetically conductive material. The sides of inner end 12 of armature 10 may be provided with a notched or indented surface 56, as illustrated, to maximize the contact area between the lower portion 54 of dog 50, and aperture 10 when dog 50 is in bridging position as illustrated in FIG. 5. In this position, as can be seen, portion 54 is in contact as well with a corresponding rib 38 to provide a circumscribing path for flow of magnetic force which circumscribes coil 5 when that coil is activated.

Figure 6:
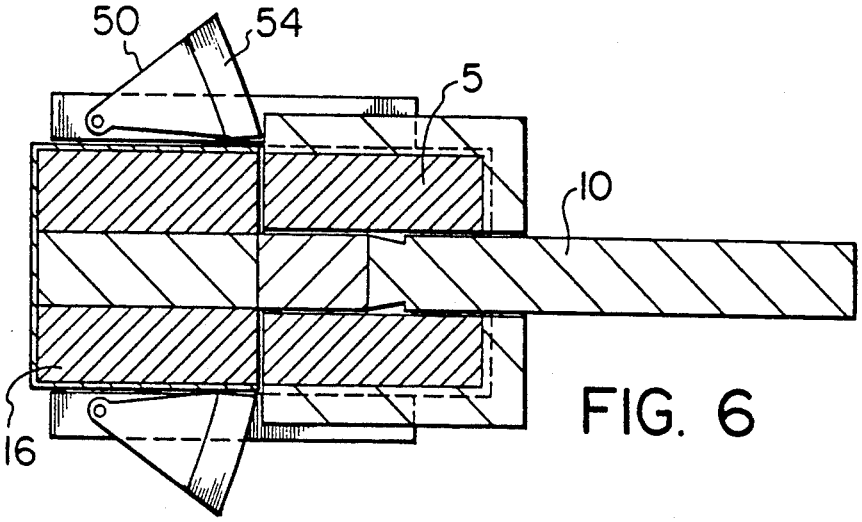

When that coil is de-activated and armature 10 is drawn out to extended position (FIG. 6), the ceasing of the flow of magnetic field through portion 54 of dog 50 frees dog 50 to be pivoted out of position between coils 5 and 16, as illustrated in FIG. 6. This action is accomplished by portions of coil 16 bearing against the angled surface 58 of dog 50, thereby swinging dog 50 about pivot 60, clear of the space between the coils as coil 16 moves towards its de-activated position adjacent coil 5.

Figure 7:
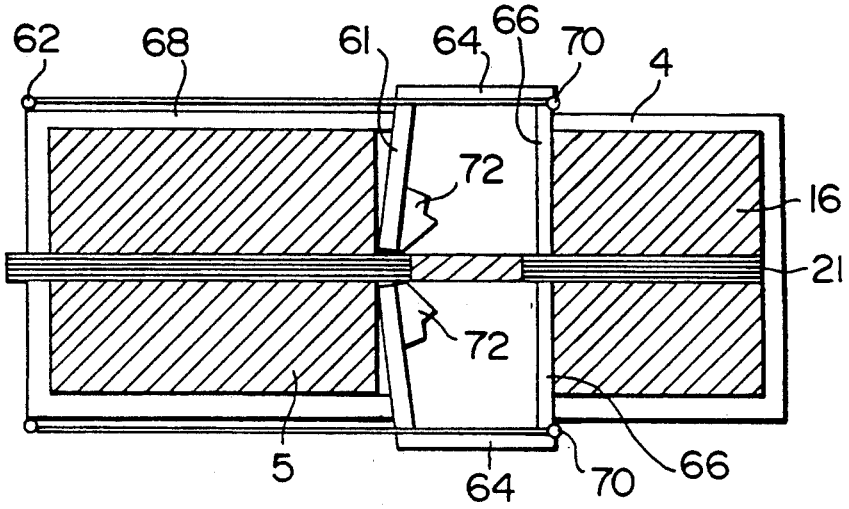
FIGS. 7 and 8 are schematic section views of alternative embodiments of solenoids in accordance with the present invention, in FIG. 7 adapted for A.C. or D.C. with the armature in retracted position, and in FIG. 8 adapted for D.C. applications only, with the armature in extended position.
Figure 8:
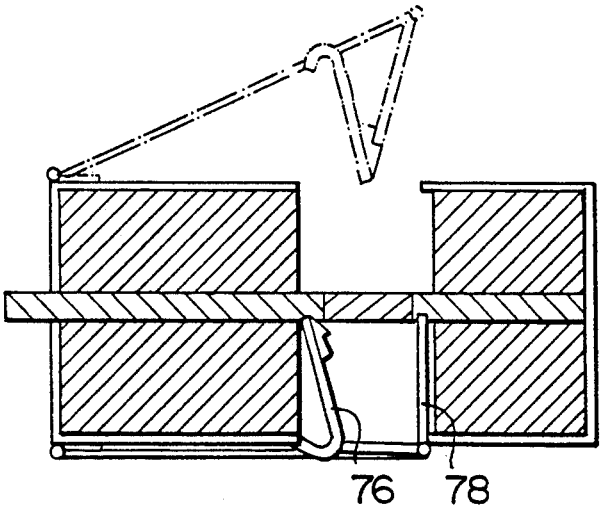

Yet a further embodiment of bridge means 30 is illustrated in FIG. 7, on a solenoid intended for A.C. or D.C. applications, and in FIG. 8, on a solenoid intended for D.C. applications only. In essence, the bridge means comprises a laminated steel (strip or) bar 61 secured at hinge 62 to the case 4 of coil 5. Hinged to a non-magnetizable bar 64 as illustrated is a moveable laminated steel (strip or) bar 66. Bars 61 and 66 are in position as illustrated, bar 61 extending between relative corresponding portions of case 4 and core 21, and bar 66 extending between armature 10 and its steel case 68 when the respective coils are activated. Upon de-activation of the coils, as armature 10 returns to extended position, the action of adjacent end 70 of case 68 on bar 66 causes that bar to pivot into seated position on non-magnetizable seat 72 located as illustrated on bar 61. Continued movement coil 16 towards coil 5 then causes bars 61, 64 and 66 to pivot outwardly, about pivot 62, to clear the space between the coils (phantom, FIG. 8).

Activation of these coils results in these steps being carried, in reverse order, until bars 61 and 66 are in bridging, conducting position as illustrated in FIG. 7.

In the embodiment of FIG. 8, intended for D.C. application only, instead of laminated steel bars 61 and 66, steel disc halves 76 and 78 respectively, may be used, the operation of bridge means 30 being similar.

Thus it is apparent that there has been provided in accordance with the invention an improved solenoid device that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention is:

1. In a solenoid of the type comprising an electrically energizable first coil positioned within a frame and consisting of one or more layers of windings about a non-magnetic form from which a magnetizable armature, having a coil end and a free end, extends, and within which the coil end of the armature moves between retracted position when the first coil is energized and extended position when the first coil is de-energized, the distance between those positions being the distance of throw of the solenoid armature, the coil end of the armature having a section of rigid non-magnetizable material of pre-determined length secured to it so as to move with the armature, and a second, electrically energizable coil consisting of one or more layers of windings about a non-magnetic form, which windings and form circumscribe a magnetizable core and are energizable in a manner independent from that of the first coil, the core of said second coil being secured to the other end of the length of non-magnetizable material so as to move the second coil with the armature from a position adjacent the first coil when the armature is in extended position to a position spaced therefrom when the armature is in retracted position, whereby when the first coil is energized to move the armature along its throw into retracted position, the second coil is simultaneously energized so as produce a repulsive magnetic force with respect to that of the first coil, the improvement characterized by magnetizable bridge means secured to the frame and automatically movable, upon energization of the coils and movement of the armature along its throw to retracted position, to become seatably positioned within the space between the coils over an end of the first coil in contact with the armature to provide across the coil end of the armature a magnetically conductive path for the magnetic field, and, upon de-energization of the coils and return of the armature to its extended position, to become automatically moved from its seated position to a position clear of the space between the first and second coils.

2. A solenoid according to claim 1 wherein the first coil is circumscribed by a magnetizable cage means wherein, when the magnetizable bridge means is moved into seated position, it simultaneously contacts the armature and the cage means, the cage and bridge means thereby providing a magnetically conductive path about the first coil for the magnetic field.

3. A solenoid according to claim 1 further provided with magnetizable bridge means secured to the frame and automatically movable, upon energization of the coils and movement of the armature along its throw to retracted position, to become seatably positioned within the space between the coils, over an end of the second coil in contact with its core to provide a magnetically conductive path for the magnetic field of the second coil.

4. A solenoid according to claim 3 wherein the second coil is circumscribed by a magnetizable cage means wherein, when the magnetizable bridge means is moved into seated position, it simultaneously contacts the armature and the cage means of the second coil, the cage and bridge means thereby providing a magnetically conductive path about the second coil for the magnetic field.

5. A solenoid according to claim 1 wherein the magnetizable bridge means comprise a plurality of strips of magnetically conductive material arranged to move clear of the space between the coils when the first coil is de-energized and the armature moves from retracted position to extended position with the coils adjacent each other, and into seated position when said coil is energized and the armature has moved to retracted position.

6. A solenoid according to claim 2 wherein the magnetizable bridge means comprise a plurality of strips of magnetically conductive material arranged to move clear of the space between the coils when the first coil is de-energized and the armature moves from retracted position to extended position with the coils adjacent each other, and into seated position when said coil is energized and the armature has moved to retracted position.

7. A solenoid according to claim 3 wherein the magnetizable bridge means comprise a plurality of strips of magnetically conductive material arranged to move clear of the space between the coils when the first coil is de-energized and the armature moves from retracted position to extended position with the coils adjacent each other, and into seated position between the coils on the first and second coils.

8. A solenoid according to claim 4 wherein the magnetizable bridge means comprise a plurality of strips of magnetically conductive material arranged to move clear of the space between the coils when the first coil is de-energized and the armature moves from retracted position to extended position with the coils adjacent each other, and into seated position between the coils on the first and second coils.

9. A solenoid according to claim 8 wherein pairs of magnetizable strips for seatable position respectively on said first and second coils are pivotally hinged to the case and are linked together by link means, said link means co-ordinating pivoting action of the linked magnetizable strips during operation of the solenoid and movement of the strips between bridging position and position clear of the space between the coils.

10. A solenoid according to claim 9 wherein the linking means is made of rigid material which will not interfere with magnetic fields, and the magnetizable strips are made of steel.

11. A solenoid according to claim 8 wherein pairs of magnetizable strips for seatable position respectively on said first and second coils are pivotally hinged to the case and to each other so as to provide pivoting action of the magnetizable strips during operation of the solenoid and movement of the strips between bridging position and position clear of the space between the coils.

12. A solenoid according to claim 11 wherein said magnetizable strips are in the form of portions of plates adapted to cover corresponding portions of the ends of the respective coils when in bridging position.

* * * * *